United States Patent [19]

DiCuya

[11] 4,018,382

[45] Apr. 19, 1977

[54] GLOVE FORM

[76] Inventor: Patsy DiCuya, 4757 Kovall, Las Vegas, Nev. 89109

[22] Filed: Oct. 15, 1975

[21] Appl. No.: 622,671

[52] U.S. Cl. ..... 223/78; 46/163

[51] Int. Cl.[2] ..... A41D 1/00

[58] Field of Search ..... 271/13, 133; 46/163; 223/78–80, 68, 66

[56] References Cited

UNITED STATES PATENTS

| | | | |
|---|---|---|---|
| 1,174,455 | 3/1916 | von Stetten | 223/79 X |
| 2,783,925 | 3/1957 | Ross | 223/78 |
| 3,159,504 | 12/1964 | Sarjanian et al. | 223/80 X |

*Primary Examiner*—G. V. Larkin

*Attorney, Agent, or Firm*—Jerry R. Seiler

[57] ABSTRACT

A glove form comprises a hand member having two hand portions and adjustable means therebetween for varying the width of the hand member, finger members extending from the hand portions and connected by threaded means whereby the distance between the finger members and hand portions may be varied, and a thumb portion pivotally secured to one of the hand portions whereby the form may be used for either the right or left hand glove.

5 Claims, 3 Drawing Figures

GLOVE FORM

BACKGROUND OF THE INVENTION

The use of glove forms is highly desirable in order to maintain the gloves in a proper and suitable shape and to minimize deterioration of the glove material due to hardening and cracking. Although such deterioration of leather or simulated leather gloves will be appreciated, it is especially troublesome with gloves worn for sporting events. Such gloves used for handball, golf, tennis, archery, skiing, bowling and the like are often produced from a leather and are relatively expensive. Especially where the gloves are worn frequently, such as in golf, tennis and bowling, with perspiration from the wearer's hands and particularly the palms, the gloves are deformed after they are removed. If the gloves are then allowed to dry in the deformed shape, when attempting to reuse them, cracking will occur as the leather shrinks, becomes somewhat brittle and hardened and which deterioration will continue until the gloves become unusable. According to the present invention, such a glove is placed on a glove tree where it will dry in its natural shape so that when reused, it will not have to be stretched and will not crack when placed on the wearer's hand.

Although glove forms have been known for some time, there have not been found devices which can be readily adapted to fit any size of glove, both hand and fingers, and which can be used for either right or left hand. Accordingly, it is an object of this invention to provide a glove form having advantages described herein in preventing premature deterioration of a glove, particularly gloves used for sporting events. It is also an object of the invention to provide a glove form which can be varied in size to accommodate substantially all or any glove size desired. The use as well as other objects will be evident from the following description.

SUMMARY OF THE INVENTION

The present invention relates to a glove form which, because of its characteristic can be adjusted to fit practically any size glove. The features of the preferred embodiment include two hand portions, means for adjusting the distance between the two hand portions whereby the width thereof may be varied to accommodate large and small hand gloves as well as any intermediate sizes. In addition, finger portions extend from the hand portions and are connected thereto by adjustable means for varying the distance therebetween thereby extending or lengthening the fingers within the form to accommodate any different glove finger length. A similarly extendable thumb portion is pivotally secured to one of the hand portions whereby the thumb portion may be moved to accommodate either right or left handed gloves.

DETAILED DESCRIPTION OF THE INVENTION

Figure 3:
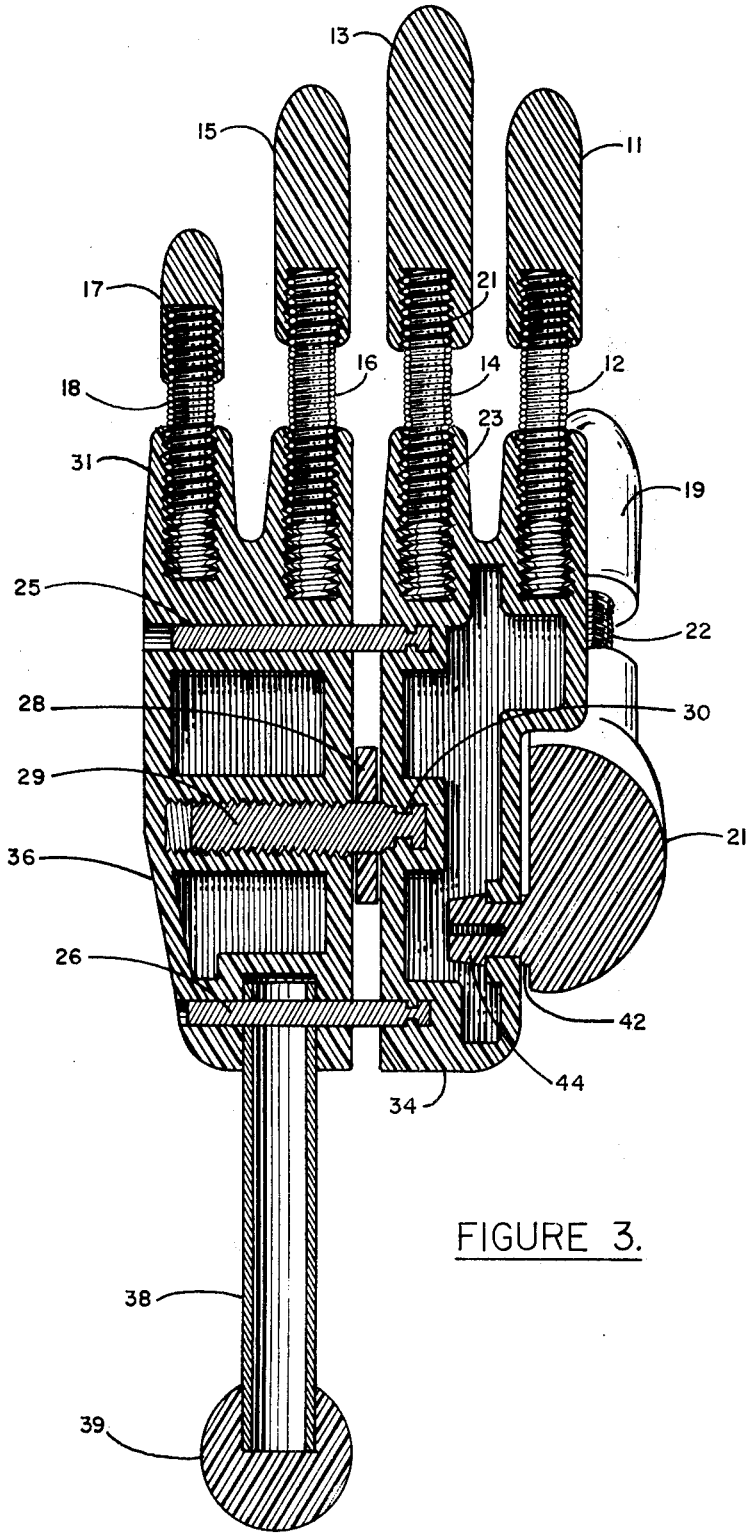
FIG. 3 is a sectional view of the invention.

Referring to the drawings in which the components are indicated by the same numerals in each of the Figures, there is shown a glove form having two hand portions 34 and 36. These hand portions define both the front or palm and back of the hand regardless of whether the form is to be used for a right or left hand glove. The two hand portions are separated or joined by bridge rods 25 and 26, one at the top and one at the bottom of each of the hand portions and extending into both portions. This feature is shown in FIG. 3 with the rods securely mounted in one of the hand portions and slidably engaged in the other hand portion. Thus, for example, the bridge rods may be secured in hand portion 34 and engaged or received in a shaft or sleeve extending through a portion of the width of hand portion 36 so that the rods can slide in and out of the sleeves. The rods maintain the hand portions in alignment relative to one another both horizontally and vertically regardless of the extent to which the distance between these hand portions is varied.

In order to change the distance between the hand portions 34 and 36, there is provided an adjustable means comprising a threaded shaft 29 threadedly engaging hand portion 36 and a knob or wheel 28 which turns threaded shaft 29. The knob or wheel 28, preferably knurled or grooved along its outer surface so that it can be easily grasped and turned with an operator's fingers, is journaled in a shaft 30 which is secured in hand portion 34 by a threaded screw or other equivalent means. Thus, in order to expand or contract the width of the hand of the glove form, knob or wheel 28 is simply turned or rotated in one direction which causes the hand portions to separate. By turning the knob in the opposite direction the width of the form will be decreased to accommodate the smaller or narrower glove.

Finger portions 11, 13, 15 and 17, corresponding to index, middle, ring and little fingers of the hand respectively, are secured on threaded members 12, 14, 16 and 18 respectively. These threaded members may threadedly engage either the hand portions or the finger portions or both. As shown, the threaded members extend from projections 31 for each of the finger portions extending upwardly from the hand portions and formed as part thereof. The threaded members may be simply threaded shafts which threadedly engage either or both of the hand and finger portions. Alternatively, and preferably, the threaded members comprise spiral springs in which the wraps of the springs act as threads so that the finger members can be turned and thus be raised or lowered relative to the hand portion. By this feature, the finger portions can be extended to any desired length depending on the size or length of the glove fingers which are being placed on the form. Although the spring embodiment is not critical, it does offer advantage in the ease in which the glove may be placed on the form. Thus, if members 12, 14, 16, 18 and 22 are springs, they will flexibly yield as a glove is being placed on the form which will make the installation somewhat easier. It will be understood that after the glove is installed on the form, the spring members return to their straight rest position shown in the drawings.

Although the device is shown with two finger portions extending from each hand portion, it may be modified so that only one finger portion will extend from one hand portion and three from the other hand portion. In other words, the two hand portions may be modified so that they are separated between the ring and little fingers or alternatively, between the index and middle fingers and otherwise having the same features for adjusting the extent of hand portion separation as previously described.

Figure 1:
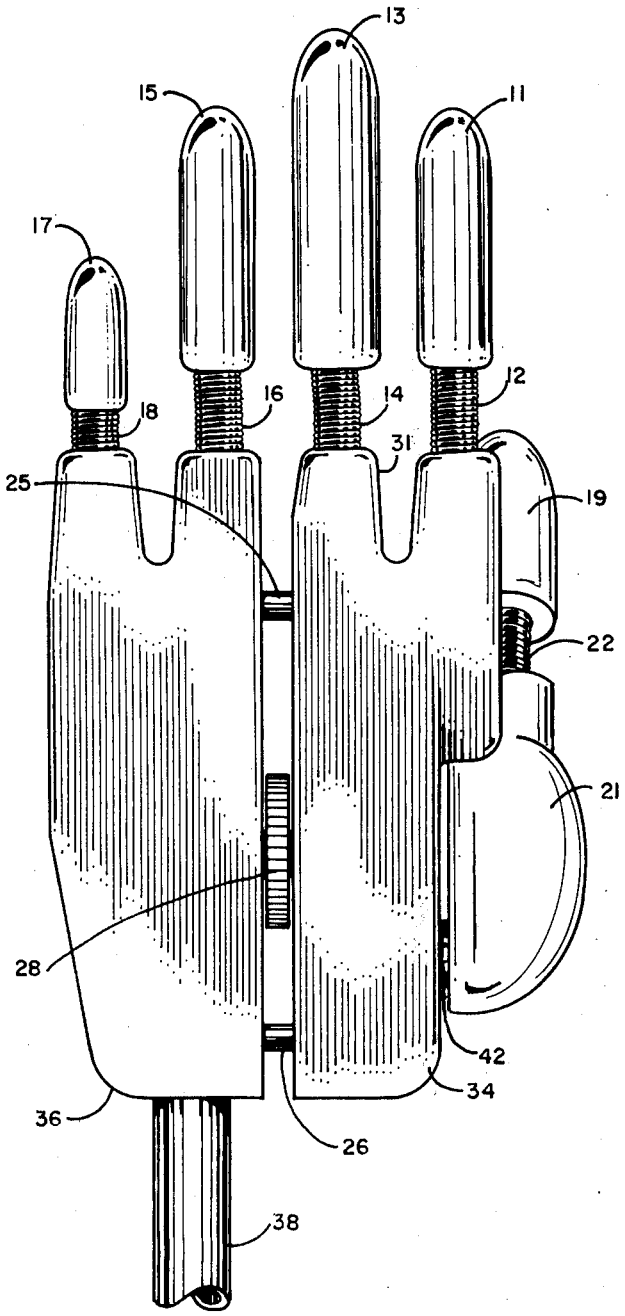
FIG. 1 is a front elevational view of the glove form of the invention.
Figure 2:
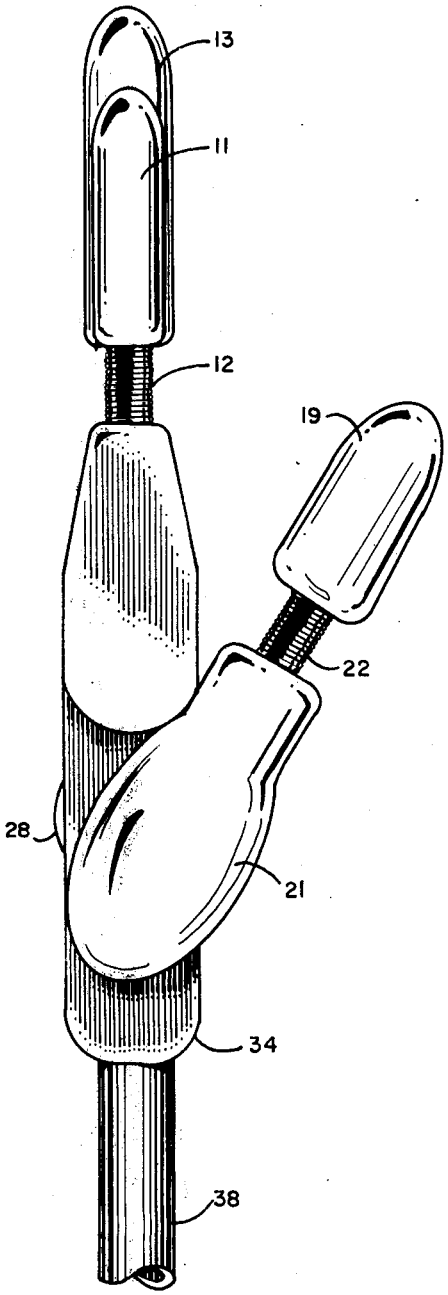
FIG. 2 is a side elevational view of the device of FIG. 1.

Another feature of the invention is the thumb of the form which comprises lower thumb portion 21 pivotally secured to first hand portion 34 and upper thumb portion 19 attached to threaded member 22 which is substantially identical to the previously described threaded members for the finger portions as is threaded engagement with the upper and lower thumb portions. A rotatable shaft 42 mounted between lower thumb portion 21 and hand portion 34 rotatably engages the hand portion so that the thumb can be moved from the position shown in FIG. 1 by simply rotating it through an arc of approximately 270°. A shoulder 44 rotatably mounted in hand portion 34 provides for this rotational or arc movement of the thumb portion while the other end of shaft 42 is secured in lower thumb portion 21. Again, this feature provides glove form use for either right or left handed gloves as desired.

A stand shaft 38 provided with a ball 39 or terminal flange may be secured to the glove form by being attached to one of the hand portions as shown. The purpose for this member is to allow it to be secured to a stand or it may otherwise be provided with means for attaching it to a golf bag, golf cart or similar means by which it is conveniently and immediately available to the user when the glove is removed and before drying, shrinking and brittleness occurs. Other modifications or embodiments within the purview of the invention will be evident to those skilled in the art.

I claim:

1. A glove form comprising first and second hand portions and adjustable means connecting said hand portions for varying the distance therebetween whereby the width of said glove form may be expanded or contracted, finger portions extending from the hand portions, threaded means connecting each finger portion and a hand portion, and a thumb portion pivotally secured to one of the hand portions.

2. The form of claim 1 wherein first and second finger portions extend from the first hand portion and third and fourth finger portions extend from the second hand portion.

3. The form of claim 1 wherein said adjustable means comprises a threaded shaft engaging one of said hand portions and connected to the other and means for turning said shaft thereby varying the distance between said hand portions.

4. The form of claim 3 wherein said means connecting said fingers and hand portions comprises a spiral spring member threadedly engaging said finger and hand portions.

5. A glove form comprising:

a. first and second hand portions, b. first and second finger portions extending from the first hand portion and third and fourth finger portions extending from the second hand portion, c. means connecting each said finger and hand portions respectively threadedly engaging at least one or the other of said finger or hand portions for varying the distance between said finger and hand portions, d. adjustable means connecting the first and second hand portions for varying the distance therebetween whereby the width of said glove form may be expanded or contracted, and e. a thumb portion pivotally secured to said first hand portion whereby said thumb portion may be moved relative to said hand portion to accommodate right or left handed gloves placed on said form.

* * * * *